US011667871B2

(12) United States Patent
Sun et al.

(10) Patent No.: US 11,667,871 B2
(45) Date of Patent: Jun. 6, 2023

(54) USE OF ALKYL DIALKYLAMINE OXIDE AND SURFACTANT BLEND TO INCREASE MILDNESS OF UNIT DOSE OR LIQUID LAUNDRY DETERGENT

(71) Applicant: Henkel AG & Co. KGaA, Duesseldorf (DE)

(72) Inventors: Wei Sun, Trumbull, CT (US); Narcisse N Toussa, Seymour, CT (US); Napaporn Slattery, Monroe, CT (US); Alma D. Calderon, Derby, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 47 days.

(21) Appl. No.: 16/948,444

(22) Filed: Sep. 18, 2020

(65) Prior Publication Data

US 2022/0089971 A1 Mar. 24, 2022

(51) Int. Cl.

| | |
|---|---|
| ***C11D 1/29*** | (2006.01) |
| ***C11D 1/22*** | (2006.01) |
| ***C11D 1/72*** | (2006.01) |
| ***C11D 1/75*** | (2006.01) |
| ***C11D 1/83*** | (2006.01) |
| ***C11D 17/04*** | (2006.01) |
| ***C11D 3/30*** | (2006.01) |
| ***C11D 11/00*** | (2006.01) |

(52) U.S. Cl.

CPC ..... *C11D 1/29* (2013.01); *C11D 1/22* (2013.01); *C11D 1/72* (2013.01); *C11D 1/83* (2013.01); *C11D 3/30* (2013.01); *C11D 11/0017* (2013.01); *C11D 17/043* (2013.01)

(58) Field of Classification Search

None

See application file for complete search history.

(56) References Cited

U.S. PATENT DOCUMENTS

| | | | | |
|---|---|---|---|---|
| 6,610,639 | B1 * | 8/2003 | Arvanitidou | C11D 1/83 510/508 |
| 6,794,349 | B2 | 9/2004 | Hafkamp et al. | |
| 8,461,089 | B2 * | 6/2013 | Woo | C11D 3/2075 510/237 |
| 8,901,059 | B2 * | 12/2014 | Evers | C11D 1/83 510/423 |
| 2011/0209291 | A1 * | 9/2011 | Sadlowski | C11D 1/29 510/340 |
| 2016/0186095 | A1 * | 6/2016 | Vockenroth | C11D 1/146 510/352 |
| 2017/0044471 | A1 | 2/2017 | Coope-Epstein et al. | |
| 2017/0198237 | A1 * | 7/2017 | Shearouse | C11D 3/3715 |
| 2018/0037858 | A1 | 2/2018 | Keuleers et al. | |
| 2019/0185785 | A1 * | 6/2019 | Seiler | C11D 1/662 |
| 2019/0225914 | A1 * | 7/2019 | Stenger | C11D 1/146 |
| 2019/0330575 | A1 | 10/2019 | Keuleers et al. | |

FOREIGN PATENT DOCUMENTS

| | | | |
|---|---|---|---|
| WO | 200008129 | A1 | 2/2000 |

* cited by examiner

*Primary Examiner* — Lorna M Douyon

(74) *Attorney, Agent, or Firm* — Bojuan Deng

(57) ABSTRACT

A detergent composition includes a surfactant component in an amount of about 20 to about 75 weight percent actives based on a total weight of the detergent composition. The surfactant component includes an alkyl ether sulfate, an alkoxylated alcohol, and a linear alkylbenzene sulfonate. The alkyl ether sulfate is present in an amount of greater than about 20 weight percent actives based on a total weight of the surfactant component. The linear alkylbenzene sulfonate is present in an amount of less than about 40 weight percent actives based on a total weight of the surfactant component. The detergent composition also includes water present in a total amount of from about 10 to about 80 weight and an alkyl dialkylamine oxide present in an amount of from about 0.1 to about 10 weight percent actives, each based on a total weight of the detergent composition.

20 Claims, No Drawings

USE OF ALKYL DIALKYLAMINE OXIDE AND SURFACTANT BLEND TO INCREASE MILDNESS OF UNIT DOSE OR LIQUID LAUNDRY DETERGENT

FIELD OF THE INVENTION

The present disclosure generally relates to a detergent composition which may be a unit dose or a liquid laundry composition. More specifically, the disclosure relates to a detergent composition that includes a particular combination of surfactants in particular weight amounts in combination with an alkyl dialkylamine oxide which facilitates an increase in mildness of the detergent composition without detrimental effect of detergency performance.

BACKGROUND OF THE INVENTION

Concentrated detergent formulations having more than 25 wt % of total surfactants have been used in many compacted liquid laundry detergent and water-soluble unit dose laundry detergent products in the market. Due to the high use level of surfactants in such compositions, the commercial products can be used at lower dosages to meet cleaning needs such that the same volumetric amount of liquid product can deliver more doses for a concentrated liquid formula as compared to other similar detergents. Increasing the number of doses in a commercial container results in a decrease in plastic waste, production costs, and transportation costs.

However, concerns have been raised about the irritation profiles of concentrated liquid formulas due to high use level of total surfactants. The commonly used surfactants, such as LAS, SLS, AES, which are robust and highly efficient to clean a wide range of soils, are not known to be mild to skin. For this reason, attempts have been made to use milder cosurfactants such as highly ethoxylated non-ionic surfactants, alkyl dimethylamine oxides (AO), alkylamidoalkylbetaines and alkyl polyglucosides as replacements. However, such attempts have resulted in compositions with compromised cleaning performance and commercial insufficiency. Accordingly, there remains an opportunity for improvement. Furthermore, other desirable features and characteristics of the present disclosure will become apparent from the subsequent detailed description of the disclosure and the appended claims, taken in conjunction this background of the disclosure.

SUMMARY OF THE INVENTION

This disclosure provides a detergent composition including a surfactant component present in an amount of about 20 to about 75 weight percent actives based on a total weight of the detergent composition. The surfactant component itself includes an alkyl ether sulfate, an alkoxylated alcohol, and a linear alkylbenzene sulfonate. The alkyl ether sulfate is present in an amount of greater than about 20 weight percent actives based on a total weight of the surfactant component and the linear alkylbenzene sulfonate is present in an amount of less than about 40 weight percent actives based on a total weight of the surfactant component. The detergent composition also includes water present in a total amount of from about 10 to about 80 weight percent based on a total weight of the detergent composition and an alkyl dialkylamine oxide present in an amount of from about 0.1 to about 10 weight percent actives based on a total weight of the detergent composition.

This disclosure also provides a unit dose detergent pack including a pouch made of a water-soluble film and the detergent composition described above that is encapsulated within the pouch. This disclosure further provides a liquid laundry detergent.

The detergent composition exhibits superior and unexpected results. More specifically, it was discovered that mildness could be improved from the addition of an alkyl dialkylamine oxide without reducing or replacing other cleaning surfactants. As such, this provides a solution to improve mildness without detrimental effect to detergency performance. This is advantageous when used in both unit dose and liquid laundry applications.

DETAILED DESCRIPTION OF THE INVENTION

The following detailed description is merely exemplary in nature and is not intended to limit the disclosure. Furthermore, there is no intention to be bound by any theory presented in the preceding background or the following detailed description.

Embodiments of the present disclosure are generally directed to detergent compositions and methods for forming the same. For the sake of brevity, conventional techniques related to detergent compositions may not be described in detail herein. Moreover, the various tasks and process steps described herein may be incorporated into a more comprehensive procedure or process having additional steps or functionality not described in detail herein. In particular, various steps in the manufacture of detergent compositions are well-known and so, in the interest of brevity, many conventional steps will only be mentioned briefly herein or will be omitted entirely without providing the well-known process details.

In one aspect, the present disclosure provides a detergent composition with improved mildness while maintaining cleaning efficiency. The detergent composition may be used in the unit dose pack detergent product or as a liquid laundry detergent product.

Detergent Composition:

This disclosure provides the detergent composition, first introduced above and hereinafter referred to as a composition. The composition may be, include, consist essentially of, or consist of, a surfactant component, water, and an alkyl dialkylamine oxide, as each is described below, e.g. in any one or more of the amounts described in greater detail below.

In one embodiment, the composition comprises the surfactant component, water, and the alkyl dialkylamine oxide.

In another embodiment, the composition consists essentially of the surfactant component, water, and the alkyl dialkylamine oxide. For example, the composition may be free of one or more optional components listed below or one more surfactant components known in the art that are not described herein.

In still another embodiment, the composition consists of the surfactant component, water, and the alkyl dialkylamine oxide.

In yet another embodiment, the composition comprises the surfactant component, water, the alkyl dialkylamine oxide, and one or more optional additives described below.

In another embodiment, the composition consists essentially of the surfactant component, water, the alkyl dialkylamine oxide, and one or more optional additives described below. For example, the composition may be free of one or more optional components listed below or one more surfactant components known in the art that are not described herein.

In another embodiment, the composition consists of the surfactant component, water, the alkyl dialkylamine oxide, and one or more optional additives described below.

In further embodiments, the composition is free of, or includes less than 1, 0.5, 0.1, 0.05, or 0.01, weight percent of, any one or more of the optional components or additives described above or below or known in the art.

Surfactant Component:

As first introduced above, the composition includes the surfactant component. The surfactant component is present in an amount of about 20 to about 75 weight percent actives based on a total weight of the detergent composition. In various embodiments, the surfactant component is present in an amount of about 25 to about 75, about 30 to about 70, about 35 to about 65, about 35 to 60, about 40 to about 60, about 45 to about 55, or about 45 to about 50, weight percent actives based on a total weight of the detergent composition. In other embodiments, the surfactant component is present in an amount of about 20, 25, 30, 35, 40, 45, 50, 55, 60, 65, 70, or 75, weight percent actives based on a total weight of the detergent composition. In various non-limiting embodiments, all values and ranges thereof, both whole and fractional, between and including all of the above, are hereby expressly contemplated for use herein.

In various embodiments, the surfactant component includes, is, consists essentially of, or consists of, an alkyl ether sulfate, an alkoxylated alcohol, and a linear alkylbenzene sulfonate. In further embodiments, the surfactant component is free of, or includes less than 5, 4, 3, 2, 1, 0.5, 0.1, 0.05, or 0.01, weight percent of, any one or more of surfactants described below or known in the art apart from the immediately aforementioned three surfactants.

In one embodiment, the surfactant component includes an alkyl ether sulfate that is a sodium C10-18 alcohol ethoxylate sulfate having about 2 to about 3 ethoxylate groups, an alkoxylated alcohol that is a C10-C18 alcohol ethoxylate that is capped with approximately 7 moles of ethylene oxide, and a linear alkylbenzene sulfonate that is an alkali metal salt of a C10-C16 alkyl benzene sulfonic acid. In various non-limiting embodiments, all values and ranges thereof, both whole and fractional, between and including all of the above, are hereby expressly contemplated for use herein.

In another embodiment, the surfactant component consists essentially of an alkyl ether sulfate that is a sodium C10-18 alcohol ethoxylate sulfate having about 2 to about 3 ethoxylate groups, an alkoxylated alcohol that is a C10-C18 alcohol ethoxylate that is capped with approximately 7 moles of ethylene oxide, and a linear alkylbenzene sulfonate that is an alkali metal salt of a C10-C16 alkyl benzene sulfonic acid. For example, the surfactant component may be free of one or more optional components listed below or one more surfactant components known in the art that are not described herein. In various non-limiting embodiments, all values and ranges thereof, both whole and fractional, between and including all of the above, are hereby expressly contemplated for use herein.

In a further embodiment, the surfactant component consists of an alkyl ether sulfate that is a sodium C10-18 alcohol ethoxylate sulfate having about 2 to about 3 ethoxylate groups, an alkoxylated alcohol that is a C10-C18 alcohol ethoxylate that is capped with approximately 7 moles of ethylene oxide, and a linear alkylbenzene sulfonate that is an alkali metal salt of a C10-C16 alkyl benzene sulfonic acid. In various non-limiting embodiments, all values and ranges thereof, both whole and fractional, between and including all of the above, are hereby expressly contemplated for use herein.

It is contemplated that the surfactant component and/or the composition as a whole may include, or be free of, one or more than one, e.g. at least one, ionic surfactant, non-ionic surfactant, anionic surfactant, zwitterionic surfactant, or combinations thereof.

Alkyl Ether Sulfate:

The alkyl ether sulfate may alternatively be described as a polyethoxylated alcohol sulfate or as an alkyl (poly) ethoxylate sulfate. Suitable non-limiting commercial examples include those sold under the trade name CALFOAM® 303 (Pilot Chemical Company, Calif.).

The alkyl ether sulfate may the following formula:

$$R—O—(C_2H_4O)_n—SO_3M'$$

wherein R' is a C8-C20 alkyl group, n is from 1 to 20, and M' is a salt-forming cation. In various embodiments, R' is C10-C18 alkyl group, n is from 1 to 15, and M' is sodium, potassium, ammonium, alkylammonium, or alkanolammonium. In another embodiment, R' is a C12-C16 alkyl group, n is from 1 to 6 and M' is sodium. In another embodiment, the alkyl ether sulfate is sodium lauryl ether sulphate (SLES). In various embodiments, the alkyl ether sulfate is further defined as sodium laureth sulfate (SLES) having the formula: $CH_3(CH_2)_{10}CH_2(OCH_2CH_2)_nOSO_3Na$ wherein n is from about 1 to about 10. In another embodiment, the alkyl ether sulfate is sodium laureth sulfate ethoxylated with about 2 to about 4 moles of ethylene oxide.

In still other embodiments, M' is sodium, potassium, ammonium, alkylammonium, or alkanolammonium. In other embodiments, R' has 8, 9, 10, 11, 12, 13, 14, 15, 16, 17, 18, 19, or 20 carbon atoms. In still other embodiments, n is 1, 2, 3, 4, 5, 6, 7, 8, 9, 10, 11, 12, 13, 14, 15, 16, 17, 18, 19, or 20. In various non-limiting embodiments, all values and ranges thereof, both whole and fractional, between and including all of the above, are hereby expressly contemplated for use herein.

The alkyl ether sulfate is present in an amount of greater than about 20 weight percent actives based on a total weight of the surfactant component. In various embodiments, the alkyl ether sulfate is present in an amount of about, or greater than about, 20, 25, 30, 35, 40, 45, 50, 55, 60, 65, 70, 75, 80, 85, 90, 95, 96, 97, 98, 99, weight percent actives based on a total weight of the surfactant component. In other embodiments, the alkyl ether sulfate is present in an amount of about 20 to about 90, about 25 to about 85, about 30 to about 80, about 35 to about 75, about 40 to about 70, about 45 to about 65, about 50 to about 60, about 50 to about 55, or about 30 to about 90, weight percent actives based on a total weight of the surfactant component. In various non-limiting embodiments, all values and ranges thereof, both whole and fractional, between and including all of the above, are hereby expressly contemplated for use herein.

Alkoxylated Alcohol:

Referring back, the alkoxylated alcohol may be a C8-C20 or C10-C18 alcohol that is capped with (or comprises) approximately 1 to 12, 1 to 10, 2 to 10, or 2 to 12 moles of an alkylene oxide. In other embodiments, the alkoxylated alcohol may be an alcohol alkoxylate that has from 8 to 20, 10 to 18, 12 to 16, or 12 to 14, carbon atoms and is an ethoxylate, propoxylate, or butoxylate and is capped with an alkylene oxide, e.g. ethylene oxide, propylene oxide, or butylene oxide. The alcohol alkoxylate may be capped with varying numbers of moles of the alkylene oxide, e.g. about 2 to about 12, about 3 to about 11, about 4 to about 10, about 5 to about 9, about 6 to about 8, or about 7 to about 8, moles. In various non-limiting embodiments, all values and ranges thereof, both whole and fractional, between and including all of the above, are hereby expressly contemplated for use herein.

In various embodiments, the alkoxylated alcohol may be present in an amount of up to about 80, 75, 70, 65, 60, 55, 50, 45, 40, 35, 30, 25, 20, 15, 10, 5, 4, 3, 2, or 1 weight percent actives based on a total weight of the surfactant component. In other embodiments, the alkoxylated alcohol may be present in an amount of from about 1 to about 80, about 5 to about 80, about 10 to about 75, about 15 to about 70, about 20 to about 65, about 25 to about 60, about 30 to about 55, about 35 to about 50, about 40 to about 45, about 10 to about 60, about 15 to about 55, about 20 to about 50, about 25 to about 45, about 30 to about 40, or about 35 to about 40, weight percent actives based on a total weight of the surfactant component. In various non-limiting embodiments, all values and ranges thereof, both whole and fractional, between and including all of the above, are hereby expressly contemplated for use herein.

Linear Alkylbenzene Sulfonate:

The linear alkylbenzene sulfonate may have a linear alkyl chain that has, e.g. 10 to 16 carbon atoms. In various embodiment, the linear alkylbenzene sulfonate has 10, 11, 12, 13, 14, 15, or 16, carbon atoms. In various embodiments, these carbon atoms are present in approximately the following mole ratios C10:C11:C12:C13 is about 13:30:33:24 having an average carbon number of about 11.6 and a content of the most hydrophobic 2-phenyl isomers of about 18-29 wt %. The linear alkylbenzene sulfonate may be any known in the art. In various non-limiting embodiments, all values and ranges thereof, both whole and fractional, between and including all of the above, are hereby expressly contemplated for use herein.

The linear alkylbenzene sulfonate is present in an amount of less than about 40 weight percent actives based on a total weight of the surfactant component. In various embodiments, the linear alkylbenzene sulfonate is present in an amount of less than about 35, 30, 25, 20, 15, 10, 5, 4, 3, 2, or 1, weight percent actives based on a total weight of the surfactant component. In still other embodiments, the linear alkylbenzene sulfonate is present in an amount of from about 1 to about 40, about 5 to about 40, about 10 to about 35, about 15 to about 30, or about 20 to about 25, weight percent actives based on a total weight of the surfactant component. In various non-limiting embodiments, all values and ranges thereof, both whole and fractional, between and including all of the above, are hereby expressly contemplated for use herein.

In one embodiment, the alkyl ether sulfate is sodium laureth sulfate ethoxylated with about 2 to about 4 moles of ethylene oxide, the linear alkyl benzenesulfonate has a linear alkyl chain that has from about 10 to about 13 carbon atoms, and the alkoxylated alcohol is an ethoxylated alcohol including a $C_8$-$C_{20}$ backbone that is ethoxylated with from about 2 to about 12 moles of ethylene oxide.

In another embodiment, the (1) alkyl ether sulfate is sodium laureth sulfate ethoxylated with about 2 to about 4 moles of ethylene oxide, the (2) alkoxylated alcohol is a C10-C18 alcohol ethoxylate that is capped with approximately 7 moles of ethylene oxide; and the (3) linear alkyl benzenesulfonate is 2-Phenyl Sulfonic Acid.

Additional Surfactants:

In other embodiments, one or more additional surfactants may be utilized or may be excluded, and may be or include cationic, anionic, non-ionic, and/or zwitterionic surfactants, and/or combinations thereof. Additional anionic surfactants may include soaps which contain sulfate or sulfonate groups, including those with alkali metal ions as cations, can be used. Usable soaps include alkali metal salts of saturated or unsaturated fatty acids with 12 to 18 carbon (C) atoms. Such fatty acids may also be used in incompletely neutralized form. Usable ionic surfactants of the sulfate type include the salts of sulfuric acid semi esters of fatty alcohols with 12 to 18 C atoms. Usable ionic surfactants of the sulfonate type include alkane sulfonates with 12 to 18 C atoms and olefin sulfonates with 12 to 18 C atoms, such as those that arise from the reaction of corresponding monoolefins with sulfur trioxide, alpha-sulfofatty acid esters such as those that arise from the sulfonation of fatty acid methyl or ethyl esters. In various non-limiting embodiments, all values and ranges thereof, both whole and fractional, between and including all of the above, are hereby expressly contemplated for use herein.

Other suitable examples of additional nonionic surfactants include alkyl glycosides and ethoxylation and/or propoxylation products of alkyl glycosides or linear or branched alcohols in each case having 12 to 18 carbon atoms in the alkyl moiety and 3 to 20, or 4 to 10, alkyl ether groups. Corresponding ethoxylation and/or propoxylation products of N-alkylamines, vicinal diols, and fatty acid amides, which correspond to the alkyl moiety in the stated long-chain alcohol derivatives, may furthermore be used. Alkylphenols having 5 to 12 carbon atoms may also be used in the alkyl moiety of the above described long-chain alcohol derivatives. In various non-limiting embodiments, all values and ranges thereof, both whole and fractional, between and including all of the above, are hereby expressly contemplated for use herein.

In other embodiments, the additional surfactant is chosen from nonionic and ionic surfactants, such as alkoxylates, polyglycerols, glycol ethers, glycols, polyethylene glycols, polypropylene glycols, polybutylene glycols, glycerol ester ethoxylates, polysorbates, alkyl ether sulfates, alkyl- and/or arylsulfonates, alkyl sulfates, ester sulfonates (sulfo-fatty acid esters), ligninsulfonates, fatty acid cyanamides, anionic sulfosuccinic acid surfactants, fatty acid isethionates, acylaminoalkane-sulfonates (fatty acid taurides), fatty acid sarcosinates, ether carboxylic acids and alkyl(ether)phosphates. In such embodiments, suitable nonionic surfactants include $C_2$-$C_6$-alkylene glycols and poly-$C_2$-$C_3$-alkylene glycol ethers, optionally, etherified on one side with a $C_1$-$C_6$-alkanol and having, on average, 1 to 9 identical or different, typically identical, alkylene glycol groups per molecule, and also alcohols and fatty alcohol polyglycol ethers, typically propylene glycol, dipropylene glycol, trimethylolpropane, and fatty alcohols with low degrees of ethoxylation having 6 to 22, typically 8 to 18, more typically 8 to 12, and even more typically 8 to 11, carbon atoms. Moreover, suitable ionic surfactants include alkyl ether sulfates, sulfosuccinic acid surfactants, polyacrylates and phosphonic acids, typically lauryl sulfate, lauryl ether sulfate, sodium sulfosuccinic acid diisooctyl ester, 1-hydroxyethane-1,1-diphosphonic acid, and diacetyltartaric esters. In various non-limiting embodiments, all values and ranges thereof, both whole and fractional, between and including all of the above, are hereby expressly contemplated for use herein.

The one or more additional surfactants may be part of the surfactant component, as described above, or may be independent from the surfactant component. In various embodiments, the one or more additional surfactants is or includes an additional anionic surfactant and/or a non-ionic surfactant. However, other surfactants such as cationic and/or zwitterionic (amphoteric) surfactants may also be utilized or may be excluded from the composition.

Water:

The detergent composition also includes water. Water is present in the composition in a total amount of from about 10 to about 80 weight percent based on a total weight of the composition. In various embodiments, the water is present in a total amount of from about 15 to about 75, about 20 to about 70, about 25 to about 65, about 30 to about 60, about 35 to about 55, about 40 to about 50, or about 45 to about 50, weight percent based on a total weight of the composition. In other embodiments, the water is present in a total amount of about 10, 15, 20, 25, 30, 35, 40, 45, 50, 55, 60, 65, 70, 75, or 80, weight percent based on a total weight of the composition. Typically, the terminology "total amount" refers to a total amount of water present in the composition from all components, i.e., not simply water added independently from, for example, the surfactant component and/or the alkyl dialkylamine oxide. In various non-limiting embodiments, all values and ranges thereof, both whole and fractional, between and including all of the above, are hereby expressly contemplated for use herein.

An independent source of water, such as DI water, may be used to dilute the composition. This water may be independent from any water present in the composition as originating from one or more components. In other words, the composition includes water originating from the components themselves. However, to further dilute the composition, the independent water source may be used.

Alkyl Dialkylamine Oxide:

The alkyl dialkylamine oxide is not particularly limited and may be any known in the art. In various embodiments, the alkyl dialkylamine oxide has the following structure:

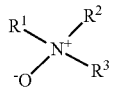

In this structure, each one of is an alkyl group that each independently has 1 to 20, 2 to 20, 4 to 18, 6 to 16, 8 to 14, 10 to 12, 10 to 20, 12 to 18, 14 to 16, 10 to 16, or 12 to 14, carbon atoms. Any one or more of these alkyl groups may be linear, branched, or cyclical. In other embodiments, any one or more of these alkyl groups independently has 1, 2, 3, 4, 5, 6, 7, 8, 9, 10, 11, 12, 13, 14, 15, 16, 17, 18, 19, or 20, carbon atoms. In various embodiments, this compound is a C12-C14 dimethylamine oxide. In other embodiments, this compound is a C12-C16 dimethylamine oxide. In other embodiments, this compound is a C10-C14 dimethylamine oxide. In other embodiments, this compound is a C10-C16 dimethylamine oxide. It is also contemplated that a mixture of a methyl group and an ethyl group or two ethyl groups can also be used. In various non-limiting embodiments, all values and ranges thereof, both whole and fractional, between and including all of the above, are hereby expressly contemplated for use herein.

The alkyl dialkylamine oxide is present in an amount of from about 0.1 to about 10 weight percent actives based on a total weight of said detergent composition. In various embodiments, the alkyl dialkylamine oxide is present in an amount of from about 0.1 to about 0.9, about 0.2 to about 0.8, about 0.3 to about 0.7, about 0.4 to about 0.6, or about 0.5, weight percent actives based on a total weight of said detergent composition. In other embodiments, the alkyl dialkylamine oxide is present in an amount of from about 1 to about 9, about 2 to about 8, about 3 to about 7, about 4 to about 6, about 5, about 2 to about 7, about 3 to about 6, about 4 to about 6, or about 0.1, 0.2, 0.3, 0.4, 0.5, 0.6, 0.7, 0.8, 0.9, 1, 2, 3, 4, 5, 6, 7, 8, 9, or 10, weight percent actives based on a total weight of said detergent composition. In other embodiments, the alkyl dialkylamine oxide is present in an amount of from about 0.5 to about 6, about 1 to about 5.5, about 1.5 to about 5, about 2 to about 4.5, about 2.5 to about 4, or about 3 to about 3.5, weight percent actives based on a total weight of the detergent composition. In various non-limiting embodiments, all values and ranges thereof, both whole and fractional, between and including all of the above, are hereby expressly contemplated for use herein.

Additives:

The composition may include one or more of the following additives or may be free of one or more of the following additives or any additives known in the art. For example, the composition may include one or more foam inhibitors (e.g. defoaming agents). Suitable foam inhibitors include, but are not limited to, fatty acids such as coconut fatty acids. The composition may include the foam inhibitor at an amount of from about 0 to about 10 weight percent, based on the total weight of the composition. In one embodiment, the composition includes a defoaming agent and a neutralization agent. In various non-limiting embodiments, all values and ranges thereof, both whole and fractional, between and including all of the above, are hereby expressly contemplated for use herein.

Bittering agents may optionally be added to hinder accidental ingestion of the composition. Bittering agents are compositions that taste bad, so children or others are discouraged from accidental ingestion. Exemplary bittering agents include denatonium benzoate, aloin, and others. Bittering agents may be present in the composition at an amount of from about 0 to about 1 weight percent, or an amount of from about 0 to about 0.5 weight percent, or an amount of from about 0 to about 0.1 weight percent in various embodiments, based on the total weight of the composition. In various non-limiting embodiments, all values and ranges thereof, both whole and fractional, between and including all of the above, are hereby expressly contemplated for use herein.

In other embodiments, additives may be or include neutralizers/pH adjustors just as monoethanolamine and the like, enzymes, optical brighteners, chelators, and combinations thereof. These additives may be chosen from any known in the art.

In one embodiment, the composition is free of, or includes less than 5, 4, 3, 2, 1, 0.5, or 0.1, weight percent of, a solvent other than water, e.g. an organic solvent, non-polar solvent, polar aprotic solvent, polar protic solvent, etc. and combinations thereof, based on a total weight of the composition. In various non-limiting embodiments, all values and ranges thereof, both whole and fractional, between and including all of the above, are hereby expressly contemplated for use herein.

Alternatively, the composition may include a non-aqueous solvent in an amount of from about 0.1 to about 30, about 0.1 to about 1, about 0.2 to about 0.9, about 0.3 to about 0.8, about 0.4 to about 0.7, about 0.5 to about 0.6, about 1 to about 30, about 5 to about 25, about 10 to about 20, or about 15 to about 20, weight percent, based on a total weight of the composition. In other embodiments, the non-aqueous solvent is chosen from glycerin, propylene glycol, and combinations thereof. Any other organic solvent may also be utilized. In various non-limiting embodiments, all values and ranges thereof, both whole and fractional, between and including all of the above, are hereby expressly contemplated for use herein.

In various non-limiting embodiments, all values and ranges thereof, both whole and fractional, between and including all of the above, are hereby expressly contemplated for use herein.

Weight Percents/Ratios of Various Components:

The surfactant component, water, and the alkyl dialkylamine oxide are generally present in amounts within the weight ranges set forth above. However, in additional embodiments, these weight ranges may be narrower and/or specific weight ratios may be utilized. These weight ranges and/or ratios may be representative of embodiments that produce special, superior, and unexpected results, such as those demonstrated in the Examples. Relative to all of the paragraphs set forth immediately below. In various non-limiting embodiments, all values and ranges thereof, both whole and fractional, between and including all of the above, are hereby expressly contemplated for use herein.

In various embodiments, the wt % actives of the various components are set forth below:

| Wt % Actives | Embodiment 1 | Embodiment 2 | Embodiment 3 | Embodiment 4 |
|---|---|---|---|---|
| Alcohol Ethoxylate | 15 | 5 | 20 | 5 |
| Alkyl Ether Sulfate | 15 | 20 | 20 | 35 |
| Linear Alkylbenzene Sulfonate | 10 | 15 | 0 | 0 |
| Alkyl Dimethylamine Oxide | 5 | 5 | 5 | 5 |

| Wt % Actives | Embodiment 5 | Embodiment 6 | Embodiment 7 | Embodiment 8 |
|---|---|---|---|---|
| Alcohol Ethoxylate | 5-15 | 5-15 | 5-20 | 5-20 |
| Alkyl Ether Sulfate | 5-15 | 5-20 | 5-20 | 5-35 |
| Linear Alkylbenzene Sulfonate | 5-15 | 5-15 | 0-20 | 0-20 |
| Alkyl Dimethylamine Oxide | 1-10 | 1-10 | 1-10 | 1-10 |

Notably, in the above table, the wt % actives of the alcohol ethoxylate, alkyl ether sulfate, and linear alkylbenzene sulfonate are based on the total weight of the surfactant component while the wt % actives of the alkyl dialkylamine oxide are based on the total weight the composition as a whole.

For example, in various embodiments, the weight ratios of actives of the alcohol ethoxylate:alkyl ether sulfate: linear alkylbenzene sulfonate is about 3:3:2; or 1:4:3: or 1:1:0; or 1:7:0. In other embodiments, the weight ratios are (1-2):(1-2):(1-2) or (1-3):(1-3):(1-3) or (1-4):(1-4):(1-4) or (1-5):(1-5):(1-5). In further embodiments, the weight ratios are (1-2):(1-2):(0-2) or (1-3):(1-3):(0-3) or (1-4):(1-4):(0-4) or (1-5):(1-5):(0-5). In various embodiments, this ratio is about (1-10):(1-10):(0-10). In the above ratios, each value may be 1, 2, 3, 4, 5, 6, 7, 8, 9, or 10 or, in some cases, zero. In various non-limiting embodiments, all values and ranges thereof, both whole and fractional, between and including all of the above, including in the table, are hereby expressly contemplated for use herein.

In various embodiments, the composition may produce any Zein score., e.g. as set forth in the Examples, when the composition is utilized in an amount of from about 0.5% to about 5% for liquid laundry applications. As is known in the art, the lower the Zein score the better performance is indicated.

Method for Increasing Mildness of a Composition:

In another aspect, the present disclosure provides a method for increasing mildness of a detergent composition. The method includes the step of combining the components of the detergent composition which desirably increases the mildness of the composition as compared to a composition that is free of the alkyl dialkylamine oxide.

It was unexpectedly discovered that mildness could be improved from the addition of an alkyl dialkylamine oxide without reducing or replacing other main cleaning surfactants. As such, this provides a solution to improve mildness without any detrimental effect to detergency performance. This is advantageous when used in both unit dose and liquid laundry applications.

Method of Forming the Detergent Composition:

This disclosure further provides a method of forming the detergent composition. The method includes the step of combining the surfactant component, water, and the alkyl dialkylamine oxide and optionally any additional solvents, surfactants, additives, etc., to form the detergent composition. Each of the aforementioned components may be combined in any order and in whole or partial amounts. All orders of addition are hereby expressly contemplated for use in various non-limiting embodiments.

Liquid Laundry Embodiment and Unit Dose Embodiment

This disclosure also provides a liquid laundry embodiment. For example, the composition may include amounts of water and/or any of the other components suitable for a liquid laundry application, as understood by those of skill in the art.

For example, a liquid laundry detergent may include any of the following individually or in any combination:

- the surfactant component described above present in an amount of from about 20 to about 60, about 25 to about 55, about 30 to about 50, about 35 to about 45, or about 35 to about 40, weight percent actives based on a total weight of the detergent composition;
- water present in an amount of from about 30 to about 80, about 35 to about 75, about 40 to about 70, about 45 to about 65, about 50 to about 60, or about 55 to about 65, weight percent based on a total weight of the detergent composition; and
- the alkyl dialkylamine oxide present in an amount of from about 0.1 to about 10, about 0.1 to about 0.9, about 0.2 to about 0.8, about 0.3 to about 0.7, about 0.4 to about 0.6, about 0.5 to about 0.6, about 1 to about 10, about 2 to about 9, about 3 to about 8, about 4 to about 7, or about 5 to about 6, weight percent actives of based on a total weight of the detergent composition.

In various non-limiting embodiments, all values and ranges thereof, both whole and fractional, between and including all of the above, including in the table, are hereby expressly contemplated for use herein.

This disclosure also provides the unit dose embodiment. For example, the composition may include amounts of water and/or any of the other components suitable for a unit dose application, as understood by those of skill in the art.

For example, a unit dose may include any of the following individually or in any combination:

- the surfactant component described above present in an amount of from about 30 to about 75, about 35 to about 70, about 40 to about 65, about 45 to about 60, or about 50 to about 55, weight percent actives based on a total weight of the detergent composition;
- water present in an amount of from about 10 to about 30, about 15 to about 25, or about 15 to about 20, weight percent based on a total weight of the detergent composition; and
- the alkyl dialkylamine oxide present in an amount of from about 0.1 to about 10, about 0.1 to about 0.9, about 0.2 to about 0.8, about 0.3 to about 0.7, about 0.4 to about 0.6, about 0.5 to about 0.6, about 1 to about 10, about 2 to about 9, about 3 to about 8, about 4 to about 7, or about 5 to about 6, weight percent actives of based on a total weight of the detergent composition.

In various non-limiting embodiments, all values and ranges thereof, both whole and fractional, between and including all of the above, including in the table, are hereby expressly contemplated for use herein.

Typically, the differentiating feature between the liquid laundry embodiments and the unit dose embodiment is the delivery method. A unit dose embodiment is typically encapsulated in a film, as described below whereas the liquid laundry embodiment is typically provided in a bottle for use. In one embodiment, both the unit dose embodiment and the liquid laundry embodiment have the same compositions.

Unit Dose Pack:

This disclosure provides a unit dose pack that includes a pouch made of a water-soluble film and the detergent composition encapsulated within the pouch, such as the unit dose embodiment described above.

A unit dose pack can be formed by encapsulating the detergent composition within the pouch, wherein the pouch includes a film. In some embodiments, the film forms one half or more of the pouch, where the pouch may also include dyes or other components. In some embodiments, the film is water soluble such that the film will completely dissolve when an exterior of the film is exposed to water, such as in a washing machine typically used for laundry. When the film dissolves, the pouch is ruptured and the contents are released. As used herein, "water soluble" means at least 2 grams of the solute (the film in one example) will dissolve in 5 liters of solvent (water in one example,) for a solubility of at least 0.4 grams per liter (g/l), at a temperature of 25 degrees Celsius (° C.) unless otherwise specified. Suitable films for packaging are completely soluble in water at temperatures of about 5° C. or greater.

In various embodiments, the film is desirably strong, flexible, shock resistant, and non-tacky during storage at both high and low temperatures and high and low humidities. In one embodiment, the film is initially formed from polyvinyl acetate, and at least a portion of the acetate functional groups are hydrolyzed to produce alcohol groups. The film may include polyvinyl alcohol (PVOH), and may include a higher concentration of PVOH than polyvinyl acetate. Such films are commercially available with various levels of hydrolysis, and thus various concentrations of PVOH, and in an exemplary embodiment the film initially has about 85 percent of the acetate groups hydrolyzed to alcohol groups. Some of the acetate groups may further hydrolyze in use, so the final concentration of alcohol groups may be higher than the concentration at the time of packaging. The film may have a thickness of from about 25 to about 200 microns (μm), or from about 45 to about 100 μm, or from about 70 to about 90 μm in various embodiments. The film may include alternate materials in some embodiments, such as methyl hydroxy propyl cellulose and polyethylene oxide. In various non-limiting embodiments, all values and ranges thereof, both whole and fractional, between and including all of the above, are hereby expressly contemplated for use herein.

The unit dose pack may be formed from a pouch having a single section, but the unit dose pack may be formed from pouches with two or more different sections in alternate embodiments. In embodiments with a pouch having two or more sections, the contents of the different sections may or may not be the same.

Method of Forming Unit Dose Pack or Liquid Laundry Composition:

This disclosure also provides a method of forming the unit dose pack. The composition is typically first formed, e.g. using shear mixing. Shear mixing may be conducted using an over-the-head mixer such as an IKA RW 20 Digital Mixer at 500 rpm. The composition may then be encapsulated within a pouch by depositing the composition within the pouch. The pouch may then be sealed to encase and enclose the composition within the pouch to form the unit dose pack. The composition is typically in direct contact with the film of the pouch within the unit dose pack. The film of the pouch is typically sealable by heat, heat and water, ultrasonic methods, or other techniques, and one or more sealing techniques may be used to enclose the composition within the pouch.

Similarly, this disclosure further provides a method of forming a liquid laundry composition. This method includes the step of combining the aforementioned components to form a liquid laundry composition.

Additional Embodiments

In one embodiment, the (1) alkyl ether sulfate is a sodium C10-18 alcohol ethoxylate sulfate having about 2 to about 3 ethoxylate groups, the (2) alkoxylated alcohol is a C10-C18 alcohol ethoxylate that is capped with approximately 7 moles of ethylene oxide, the (3) linear alkylbenzene sulfonate is an alkali metal salt of a C10-C16 alkyl benzene sulfonic acid, and the alkyl dialkylamine oxide is C12-C14 dimethylamine oxide.

In another embodiment, the (1) alkyl ether sulfate is present in an amount of from about 30 to about 90 weight percent actives based on a total weight of the surfactant component, the (2) alkoxylated alcohol is present in an amount of from about 10 to about 60 weight percent actives based on a total weight of the surfactant component, the (3) linear alkylbenzene sulfonate is present in an amount of from about zero to about 40 weight percent actives based on a total weight of the surfactant component, and the alkyl dialkylamine oxide is present in an amount of from about 0.5 to about 6 weight percent actives based on a total weight of the detergent composition.

In other embodiments, the (1) alkyl ether sulfate is present in an amount of from about 30 to about 90 weight percent actives based on a total weight of the surfactant component, the (2) alkoxylated alcohol is present in an amount of from about 10 to about 60 weight percent actives based on a total weight of the surfactant component, the (3) linear alkylbenzene sulfonate is present in an amount of from about zero to about 40 weight percent actives based on a total weight of the surfactant component, and the alkyl dialkylamine oxide is present in an amount of from about 0.5 to about 6 weight percent actives based on a total weight of the detergent composition.

In a further embodiment, any one or more of the aforementioned surfactant components may consist essentially of (1), (2), and (3) or consist of (1), (2), and (3). The terminology "consist essentially of" may be as defined above. For example, the surfactant component may be free of, or include less than 5, 4, 3, 2, 1, 0.5, 0.1, 0.05, or 0.01, weight percent of, any one or more of surfactants apart from the immediately aforementioned three surfactants.

In other embodiments, the alkyl dialkylamine oxide is C10-C18 dimethylamine oxide. Alternatively, the alkyl dialkylamine oxide is C12-C14 dimethylamine oxide.

In other embodiments, the (1) alkyl ether sulfate is present in an amount of greater than about 25 weight percent actives based on a total weight of the surfactant component, the (2) alkoxylated alcohol is present in an amount of from about 10 to about 60 weight percent actives based on a total weight of the surfactant component, the (3) linear alkylbenzene sulfonate is present in an amount of less than about 30 weight percent actives based on a total weight of the surfactant component, and the alkyl dialkylamine oxide is present in an amount of from about 0.5 to about 6 weight percent actives based on a total weight of the detergent composition.

In other embodiments, the (1) alkyl ether sulfate is present in an amount of greater than about 25 weight percent actives based on a total weight of the surfactant component, the (2) alkoxylated alcohol is present in an amount of from about 10 to about 60 weight percent actives based on a total weight of the surfactant component, the (3) linear alkylbenzene sulfonate is present in an amount of less than about 30 weight percent actives based on a total weight of the surfactant component, and the alkyl dialkylamine oxide is present in an amount of from about 0.5 to about 6 weight percent actives based on a total weight of the detergent composition.

In further embodiments, (1) is a sodium C10-18 alcohol ethoxylate sulfate having about 2 to about 3 ethoxylate groups and present in an amount of from about 37 to about 88 weight percent actives based on a total weight of the surfactant component; (2) is a C10-C18 alcohol ethoxylate that is capped with approximately 7 moles of ethylene oxide and present in an amount of from about 12 to about 50 weight percent actives based on a total weight of the surfactant component, and (3) comprises a linear alkylbenzene sulfonate comprising an alkali metal salt of a C10-C16 alkyl benzene sulfonic acid and present in an amount of from about 0 to about 38 weight percent actives based on a total weight of the surfactant component.

In further embodiments, (1) has the formula R'—O—$(C_2H_4O)_n$—$SO_3M'$, wherein R' is a C8-C20 alkyl group, n is from 1 to 20, and M' is a salt-forming cation, (2) is a C10-C18 alcohol ethoxylate, and (3) comprises an alkali metal salt of a C10-C16 alkyl benzene sulfonic acid.

In still other embodiments, a detergent composition includes A. a surfactant component present in an amount of about 40 weight percent actives based on a total weight of the detergent composition and consisting of; (1) a sodium C10-18 alcohol ethoxylate sulfate having about 2 to about 3 ethoxylate groups and present in an amount of from about 24 to about 88 weight percent actives based on a total weight of the surfactant component; (2) a C10-C18 alcohol ethoxylate that is capped with approximately 7 moles of ethylene oxide and present in an amount of from about 12 to about 50 weight percent actives based on a total weight of the surfactant component; and (3) at least one anionic surfactant comprising a linear alkylbenzene sulfonate comprising an alkali metal salt of a C10-C16 alkyl benzene sulfonic acid and present in an amount of from about 0 to about 38 weight percent actives based on a total weight of the surfactant component; B. water present in a total amount of from about 25 to about 30 weight percent based on a total weight of the detergent composition; and C. C12-C14 dimethylamine oxide present in an amount of about 5 weight percent actives based on a total weight of the detergent composition.

In other embodiment, a unit dose detergent pack includes a pouch made of a water-soluble film; and a detergent composition encapsulated within the pouch, wherein the detergent composition comprises: A. a surfactant component present in an amount of about 20 to about 75 weight percent actives based on a total weight of the detergent composition and comprising; (1) an alkyl ether sulfate; (2) an alkoxylated alcohol; and (3) a linear alkylbenzene sulfonate; wherein the alkyl ether sulfate is present in an amount of greater than about 20 weight percent actives based on a total weight of the surfactant component and the linear alkylbenzene sulfonate is present in an amount of less than about 40 weight percent actives based on a total weight of the surfactant component; B. water present in a total amount of from about 10 to about 80 weight percent based on a total weight of the detergent composition; and C. an alkyl dialkylamine oxide present in an amount of from about 0.1 to about 10 weight percent actives based on a total weight of the detergent composition.

In other related embodiments, the (1) alkyl ether sulfate is a sodium C10-18 alcohol ethoxylate sulfate having about 2 to about 3 ethoxylate groups, the (2) alkoxylated alcohol is a C10-C18 alcohol ethoxylate that is capped with approximately 7 moles of ethylene oxide, the (3) linear alkylbenzene sulfonate is an alkali metal salt of a C10-C16 alkyl benzene sulfonic acid, and the alkyl dialkylamine oxide is C12-C14 dimethylamine oxide.

In other related embodiments, the surfactant component consists of (1) that is a sodium C10-18 alcohol ethoxylate sulfate having about 2 to about 3 ethoxylate groups and present in an amount of from about 37 to about 88 weight percent actives based on a total weight of the surfactant component, (2) that is a C10-C18 alcohol ethoxylate that is capped with approximately 7 moles of ethylene oxide and present in an amount of from about 12 to about 50 weight percent actives based on a total weight of the surfactant component, and (3) comprises a linear alkylbenzene sulfonate comprising an alkali metal salt of a C10-C16 alkyl benzene sulfonic acid and present in an amount of from about 0 to about 38 weight percent actives based on a total weight of the surfactant component, wherein the water is present in a total amount of from about 25 to about 30 weight percent based on a total weight of the detergent composition; and the alkyl dialkylamine oxide is a C12-C14 dimethylamine oxide present in an amount of about 5 weight percent actives based on a total weight of the detergent composition.

EXAMPLES

Skin mildness was determined using an in-vitro method, Zein solubilization test as described in Gott, E., Aesthet.

Medzin., Tenside 15: 313 (1966). The technique uses the solubilization of zein, the principal protein of the corn kernel, as a measure of the harshness of a surfactant or fully-formulated detergent composition. It is a test which correlates well with in-vivo tests and is relatively quick and easy to carry out. In various embodiments, it is also contemplated that the method described in US 2018/0016523 may also be utilized as this reference is expressly incorporated herein in its entirety by reference in various non-limiting embodiments.

A Zein Score is typically described as an percentage of Zein protein solubilized by a given liquid composition. Typically, the less protein solubilized, the milder the liquid composition.

Test Procedure:

All of the liquid formulations were tested in a 3% water solution, and 3 g Zein powder were added in above solutions and mixed for 1 hour. The solution was then filtered to remove undissolved residues and dried afterwards overnight. The weight ratio of the filtered solution before and after drying determines the solid matter % of the filtered solution, which is the total solid matter % of detergent and solubilized Zein, marked as Value A.

A reference sample were tested in a 3% water solution without adding Zein powder. The solution was also filtered, dried and weighted before and after drying to determine the solid matter % of detergent, marked as Value B.

The solubilized Zein score was then calculated by the differences of A and B:

$$\text{Zein score}=A-B$$

Since zein solubilization is a measure of harshness, the higher the Zein score, the greater the skin irritation potential. Therefore, a lower Zein score or reduction of Zein score vs. control formula shows the tested formulation has improved mildness compared to the control formula.

The following abbreviations are used in the Examples:

LAS: linear alkyl benzenesulfonate that has a linear alkyl chain that has from about 10 to about 13 carbon atoms;

AES: a C10-18 alcohol ethoxylate sulfate having 2-3 ethoxylate groups and the formula: R—O—C—C—O—C—C—O—C—C—O—$SO_3$Na;

SLS: Sodium Lauryl Sulphate;

NI: a C10-C18 alcohol ethoxylate that is capped with approximately 7 moles of ethylene oxide; and AO: C12-C14 alkyl dimethylamine oxide.

In all of the below, the amounts of the various components are weight percent actives, unless otherwise indicated.

A Design of Experiments (DOE) was carried out to investigate the effect of adding amine oxide to improve Zein score of concentrated liquid detergents with different surfactant ratios. Three main cleaning surfactants are used, which are LAS, AES and NI. A mixture design of simplex centroid method was deployed to design the surfactant ratios for the DOE, ranging the level of LAS from 0 to 30%; AES from 5 to 35%; and NI from 5 to 35%. The total amount of 3 main surfactants are kept at 40% in all of formulations. Samples were made with and without 5% AO on top for each surfactant option. The Zein score of samples with and without 5% AO were measured, and noted as Zein-w/AO and Zein-no AO, respectively. The differences of Zein-w/AO vs. Zein-no AO is the net contribution of AO to the Zein score, which is noted as A ZeinAO.

As shown in Table 1 below, all the results of A ZeinAO showed negative values, indicating the introduction of AO improves the mildness of formulations. Differences of larger than 0.3 value in Zein Score show statistical differences based on method variations. Based on the data of Δ ZeinAO listed in Table 1, Reference A1-A3 of low AES surfactant options (the percentage of AES in the total amount of 3 main surfactants is less than 20%) showed less than 0.3 value of |Δ ZeinAO|, whilst Inventive A1-A4 of high AES and Low LAS surfactant options (the percentage of AES in the total amount of 3 main surfactants is higher than 20%, and the percentage of LAS in the total amount of 3 main surfactants is lower than 40%) showed larger than 0.3 value of |Δ ZeinAO|. Therefore, this shows that the addition of AO in these surfactant options provided statistically significant improvement on the mildness profile.

TABLE 1

Formulations of Tested Examples and Test Result of Zein Score

| Tested Formulations, wt % Actives | Ref. A1 | Ref. A2 | Ref. A3 | Inv. A1 | Inv. A2 | Inv. A3 | Inv. A4 |
|---|---|---|---|---|---|---|---|
| Design of Experiment (DoE) options | 1 | 6 | 7 | 5 | 4 | 3 | 2 |
| Alcohol ethoxylate, C25-7 | 5 | 35 | 20 | 15 | 5 | 20 | 5 |
| Alkyl ether sulfate, C25-3 AES | 5 | 5 | 5 | 15 | 20 | 20 | 35 |
| Alkyl benzene sulfonic acid, HLAS (i.e., linear alkylbenzene sulfonate) | 30 | 0 | 15 | 10 | 15 | 0 | 0 |
| Alkyl Dimethylamine Oxide* (Two Compositions) | 0; 5 | 0; 5 | 0; 5 | 0; 5 | 0; 5 | 0; 5 | 0; 5 |
| Palm Kernel Fatty Acid | 10 | 10 | 10 | 10 | 10 | 10 | 10 |
| Monoethanolamine | 8.6 | 2 | 5.3 | 4.2 | 5.3 | 2 | 2 |
| PEI-EO polymer, Sokalan HP20 | 4.8 | 4.8 | 4.8 | 4.8 | 4.8 | 4.8 | 4.8 |
| Sodium Sulfite | 0.2 | 0.2 | 0.2 | 0.2 | 0.2 | 0.2 | 0.2 |
| Bitrex | 0.05 | 0.05 | 0.05 | 0.05 | 0.05 | 0.05 | 0.05 |
| Propylene Glycol | 2 | 2 | 2 | 2 | 2 | 2 | 2 |
| Glycerine (Two Compositions) | 5.1; 0.1 | 12.9; 7.9 | 9.0; 4.0 | 10.0; 5.0 | 8.6; 3.6 | 12.5; 7.5 | 12.0; 7.0 |
| Total Water Content | 28 | 28 | 28 | 28 | 28 | 28 | 28 |
| Percentage of AES in (AES + NI + LAS) | 13% | 13% | 13% | 37% | 50% | 50% | 88% |

TABLE 1-continued

Formulations of Tested Examples and Test Result of Zein Score

| Tested Formulations, wt % Actives | Ref. A1 | Ref. A2 | Ref. A3 | Inv. A1 | Inv. A2 | Inv. A3 | Inv. A4 |
|---|---|---|---|---|---|---|---|
| Percentage of LAS in (AES + NI + LAS) | 75% | 0% | 38% | 25% | 38% | 0% | 0% |
| $Zein_{no\ AO}$ | 4.69 | 0.51 | 2.63 | 2.93 | 4.02 | 2.08 | 3.15 |
| Zein-w/AO | 4.51 | 0.39 | 2.34 | 2.49 | 3.52 | 1.33 | 2.72 |
| $\Delta\ Zein_{AO}$ | −0.18 | −0.13 | −0.29 | −0.44 | −0.5 | −0.75 | −0.43 |

*Trade name: Ammonyx from Stepan

A prediction model was then created based on the test result of 7 DOE options. Table 2 shows the prediction result of Δ ZeinAO of more examples with different AES and LAS levels. Table 2 clearly shows that the contribution of AO is dependent of the AES and LAS level in the total amount of the three main surfactants.

The surfactant compositions (Inventive B2-B5) of higher than 20% AES and Lower than 40% LAS in the total amount of 3 surfactants are predicted to present larger than 0.3 value of |Δ ZeinAO|, that showing the addition of AO will provide statistically significant improvement to Zein score; and the surfactant compositions (Inventive B3-B5) of higher than 25% AES and lower than 30% LAS in the total amount of 3 surfactants are predicted to present larger than 0.4 value of |Δ ZeinAO|, indicating the addition of AO showed an even larger effect of improving mildness in those surfactant compositions.

TABLE 2

Prediction Result of Zein Scores of Different Surfactant Options

| Prediction Examples Wt % Actives | Ref. B1 | Ref. B2 | Inv. B2 | Inv. B3 | Inv. B4 | Inv. B5 |
|---|---|---|---|---|---|---|
| Alcohol ethoxylate, C25-7 | 15.2 | 15.8 | 17 | 19.1 | 16.3 | 18.6 |
| Alkyl ether sulfate, C25-3 AES | 5 | 8 | 9.5 | 11 | 17 | 17 |
| Alkyl benzene sulfonic acid, HLAS (i.e., linear alkylbenzene sulfonate) | 19.8 | 16.2 | 13.5 | 9.9 | 6.7 | 4.4 |
| Percentage of AES in (AES + NI + LAS) | 13% | 20% | 24% | 28% | 43% | 43% |
| Percentage of LAS in (AES + NI + LAS) | 50% | 41% | 34% | 25% | 17% | 11% |
| $\Delta\ Zein_{AO}$ Prediction | −0.2 | −0.31 | −0.37 | −0.43 | −0.59 | −0.62 |

Additional Examples 3 additional examples were tested, and results are shown in Table 3 below. Based on the value of Δ $Zein_{AO}$, a reference composition C1 having 0% AES and 50% LAS relative to a total amount of 3 surfactants showed about 0.3 value of |Δ ZeinAO|. Inventive compositions C2-C3 having higher than 20% AES and lower than 30% LAS in the total amount of 3 surfactants presented a value of |Δ ZeinAO| larger than 0.3 which demonstrates that the addition of AO in surfactant compositions with higher than 20% AES and lower than 30% LAS will provide statistically significant improvement to Zein score.

TABLE 3

Formulations of Tested Examples and Test Result of Zein Score

| Tested Formulations, wt % Actives | Ref. C1 | Inv. C2 | Inv. C3 |
|---|---|---|---|
| Alcohol ethoxylate, C25-7 | 20 | 20 | 20 |
| Alkyl ether sulfate, C25-3 AES | 0 | 10 | 20 |
| Alkyl benzene sulfonic acid, HLAS (i.e., linear alkylbenzene sulfonate) | 20 | 10 | 0 |
| Alkyl Dimethylamine Oxide* | 0; | 0; | 0; |
| (Two Compositions) | 5 | 5 | 5 |
| Palm Kernel Fatty Acid | 10 | 10 | 10 |
| Monoethanolamine | 6.4 | 4.2 | 0.2 |
| PEI-EO polymer, Sokalan HP20 | 4.8 | 4.8 | 4.8 |
| Sodium Sulfite | 0.2 | 0.2 | 0.2 |
| Bitrex | 0.05 | 0.05 | 0.05 |
| Propylene Glycol | 8.2 | 8.2 | 8.2 |
| Glycerine | 7.2; | 7.2; | 7.2; |
| (Two Compositions) | 2.2 | 2.2 | 2.2 |
| Total Water Content | 22.2 | 22.2 | 22.2 |
| Percentage of AES in (AES + NI + LAS) | 0% | 25% | 50% |
| Percentage of LAS in (AES + NI + LAS) | 50% | 25% | 0% |
| $Zein_{no\ AO}$ | 3.02 | 2.17 | 1.55 |
| Zein-w/AO | 2.69 | 1.72 | 0.93 |
| $\Delta\ Zein_{AO}$ | −0.33 | −0.45 | −0.62 |

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment. It being understood that various changes may be made in the function and arrangement of elements described in an exemplary embodiment without departing from the scope as set forth in the appended claims.

What is claimed is:

1. A detergent composition comprising:

A. a surfactant component present in an amount of about 40 to about 70 weight percent actives based on a total weight of said detergent composition and consisting of;

(1) a sodium C10-18 alcohol ethoxylate sulfate having about 2 to about 3 ethoxylate groups present in an amount of from about 9.5 to about 35 weight percent actives based on a total weight of said detergent composition;

(2) a C10-C18 alcohol ethoxylate that is capped with approximately 7 moles of ethylene oxide present in an amount of from about 5 to about 20 weight percent actives based on a total weight of said detergent composition; and (3) an alkali metal salt of a C10-C16 alkyl benzene sulfonic acid present in an amount of from about 0 and up to about 15 weight percent actives based on a total weight of said detergent composition;

B. water present in a total amount of from about 10 to about 80 weight percent based on a total weight of said detergent composition; and C. a C12-C14 dimethylamine oxide and present in an amount of about 5 weight percent actives based on a total weight of said detergent composition, wherein said detergent composition is free of additional surfactants.

2. The detergent composition of claim 1 wherein said (2) C10-C18 alcohol ethoxylate is present in an amount of from about 10 to about 20 weight percent actives based on a total weight of said detergent composition.

3. The detergent composition of claim 1 wherein:

(1) is present in an amount of about 15 weight percent actives based on a total weight of said detergent composition;

(2) is present in an amount of about 15 weight percent actives based on a total weight of said detergent composition; and (3) is present in an amount of about 10 weight percent actives based on a total weight of said detergent composition.

4. The detergent composition of claim 1 wherein:

(1) is present in an amount of about 20 weight percent actives based on a total weight of said detergent composition;

(2) is present in an amount of about 5 weight percent actives based on a total weight of said detergent composition; and (3) is present in an amount of about 15 weight percent actives based on a total weight of said detergent composition.

5. The detergent composition of claim 1 wherein:

(1) is present in an amount of about 20 weight percent actives based on a total weight of said detergent composition;

(2) is present in an amount of about 20 weight percent actives based on a total weight of said detergent composition; and (3) is present in an amount of about 0 weight percent actives based on a total weight of said detergent composition.

6. The detergent composition of claim 1 wherein:

(1) is present in an amount of about 35 weight percent actives based on a total weight of said detergent composition;

(2) is present in an amount of about 5 weight percent actives based on a total weight of said detergent composition; and (3) is present in an amount of about 0 weight percent actives based on a total weight of said detergent composition.

7. The detergent composition of claim 1 wherein:

(1) is present in an amount of about 9.5 weight percent actives based on a total weight of said detergent composition;

(2) is present in an amount of about 17 weight percent actives based on a total weight of said detergent composition; and (3) is present in an amount of about 13.5 weight percent actives based on a total weight of said detergent composition.

8. The detergent composition of claim 1 wherein:

(1) is present in an amount of about 11 weight percent actives based on a total weight of said detergent composition;

(2) is present in an amount of about 19.1 weight percent actives based on a total weight of said detergent composition; and (3) is present in an amount of about 9.9 weight percent actives based on a total weight of said detergent composition.

9. The detergent composition of claim 1 wherein:

(1) is present in an amount of about 17 weight percent actives based on a total weight of said detergent composition;

(2) is present in an amount of about 16.3 weight percent actives based on a total weight of said detergent composition; and (3) is present in an amount of about 6.7 weight percent actives based on a total weight of said detergent composition.

10. The detergent composition of claim 1 wherein:

(1) is present in an amount of about 17 weight percent actives based on a total weight of said detergent composition;

(2) is present in an amount of about 18.6 weight percent actives based on a total weight of said detergent composition; and (3) is present in an amount of about 4.4 weight percent actives based on a total weight of said detergent composition.

11. The detergent composition of claim 1 wherein:

(1) is present in an amount of from about 9.5 to about 17 weight percent actives based on a total weight of said detergent composition;

(2) is present in an amount of from about 15 to about 20 weight percent actives based on a total weight of said detergent composition; and (3) is present in an amount of from about 0 to about 10 weight percent actives based on a total weight of said detergent composition.

12. The detergent composition of claim 1 wherein (1) is present in an amount of from about 15 to about 35 weight percent actives based on a total weight of said detergent composition.

13. The detergent composition of claim 1 wherein (1) is present in an amount of from about 20 to about 35 weight percent actives based on a total weight of said detergent composition.

14. The detergent composition of claim 1 wherein (2) is present in an amount of from about 5 to about 15 weight percent actives based on a total weight of said detergent composition.

15. The detergent composition of claim 1 wherein (2) is present in an amount of from about 15 to about 20 weight percent actives based on a total weight of said detergent composition.

16. The detergent composition of claim 1 wherein (3) is present in an amount of from about 10 to about 15 weight percent actives based on a total weight of said detergent composition.

17. The detergent composition of claim 1 wherein (3) is present in an amount of about zero weight percent actives based on a total weight of said detergent composition.

18. A unit dose detergent pack comprising:

a pouch made of a water-soluble film; and a detergent composition encapsulated within said pouch, wherein said detergent composition comprises:

A. a surfactant component present in an amount of about 40 to about 70 weight percent actives based on a total weight of said detergent composition and consisting of;

(1) a sodium C10-18 alcohol ethoxylate sulfate having about 2 to about 3 ethoxylate groups present in an amount of from about 9.5 to about 35 weight percent actives based on a total weight of said detergent composition;

(2) a C10-C18 alcohol ethoxylate that is capped with approximately 7 moles of ethylene oxide present in an amount of from about 5 to about 20 weight percent actives based on a total weight of said detergent composition; and (3) an alkali metal salt of a C10-C16 alkyl benzene sulfonic acid present in an amount of from about 0 and up to about 15 weight percent actives based on a total weight of said detergent composition;

B. water present in a total amount of from about 10 to about 80 weight percent based on a total weight of said detergent composition; and C. a C12-C14 dimethylamine oxide and present in an amount of about 5 weight percent actives based on a total weight of said detergent composition, wherein said detergent composition is free of additional surfactants.

19. The unit dose detergent pack of claim 18 having a ΔZein score of less than −0.37.

20. The unit dose detergent pack of claim 18 wherein:

(1) is present in an amount of from about 9.5 to about 17 weight percent actives based on a total weight of said detergent composition;

(2) is present in an amount of from about 15 to about 20 weight percent actives based on a total weight of said detergent composition; and (3) is present in an amount of from about 0 to about 10 weight percent actives based on a total weight of said detergent composition.

* * * * *